US005372368A

United States Patent [19]

Pavonetti

[11] Patent Number: 5,372,368

[45] Date of Patent: Dec. 13, 1994

[54] COLLAPSIBLE SOCCER GOAL

[76] Inventor: O. F. Pavonetti, 64 Rockledge Rd. 1A, Hartsdale, N.Y. 10530

[21] Appl. No.: 180,282

[22] Filed: Jan. 12, 1994

[51] Int. Cl.[5] ..... A63B 63/00

[52] U.S. Cl. ..... 273/411; 273/127 B

[58] Field of Search ..... 273/411, 127 B, 27 A

[56] References Cited

U.S. PATENT DOCUMENTS

| | | | |
|---|---|---|---|
| 2,220,158 | 9/1935 | Oakes et al. | 273/411 |
| 2,449,708 | 9/1948 | Lindsay | 273/127 B |
| 4,420,158 | 12/1983 | Klock | 273/127 B |
| 4,702,478 | 10/1987 | Kruse | 273/127 B |
| 5,048,844 | 9/1991 | Hasdtine | 273/411 |

FOREIGN PATENT DOCUMENTS

| | | | |
|---|---|---|---|
| 2632868 | 12/1989 | France | 273/127 B |
| 2335693 | 1/1975 | Germany | 273/411 |
| 2630921 | 7/1978 | Germany | 273/411 |

*Primary Examiner*—Theatrice Brown

*Attorney, Agent, or Firm*—Terry M. Gernstein

[57] ABSTRACT

A soccer goal includes two upright members to which a crossbar is connected. Each of the upright members includes a top and a bottom portion hingeably connected together and the bottom portion is hingeably connected to a base. The crossbar includes two portions each of which includes two sections hingeably connected together. The two portions are releasably locked together in the set up condition of the goal. Each of two support bars is connected at a proximal end thereof to a 270° hinge that is connected to one of the upright members to extend away from that hinge. The distal end of each support bar is releasably attached to one section of the crossbar, and the support bar has a length measured between its distal and proximal ends that exceeds one-half the length of the section to which it is attached. The crossbar portions are thus supported in the manner of a modified overhanging beam which extends beyond one of its supports but is supported for a substantial portion of its overall length.

8 Claims, 6 Drawing Sheets

COLLAPSIBLE SOCCER GOAL

TECHNICAL FIELD OF THE INVENTION

The present invention relates to the general art of goals for games, and to the particular field of soccer goals.

BACKGROUND OF THE INVENTION

Games, such as soccer, football, lacrosse, and the like are often played on a common playing field. Such games often require different goals. Therefore, one goal must be removed from the playing field and another goal set up before a game, such as soccer, can begin.

The inventor has found that removal and set up of a soccer goal, as well as storage thereof, can be onerous. While the art contains examples of goals, and soccer goals, the inventor is not aware of any soccer goal that can be easily collapsed, yet efficiently set up. This is especially true for soccer goals that can meet NCAA or professional size standards.

If the goal is collapsed, it must be strong enough to withstand the normal abuse received in a game while still securely holding a net in place, and holding that net securely all the way across the width dimension of the goal.

Therefore, there is a need for a soccer goal that meets NCAA or professional size standards, yet can be efficiently collapsed and set up, and will remain stable and securely hold the net in proper position once the goal is set up.

OBJECTS OF THE INVENTION

It is a main object of the present invention is provide a collapsible soccer goal.

It is another object of the present invention to provide a collapsible soccer goal which can meet NCAA and professional size standards.

It is another object of the present invention to provide a collapsible soccer goal which can meet NCAA and professional size standards yet which can be easily collapsed and set up, yet is extremely stable in the set up configuration.

SUMMARY OF THE INVENTION

These, and other, objects are achieved by a soccer goal that includes two crossbar members, each of which is in the form of a beam, as well as two upright members, each of which has net-supporting arms hingeably connected thereto. Each crossbar member and each upright member is formed of two portions hingeably connected together. The crossbar members are easily attached to, and detached from, the upright members thus further facilitating set up and knock down of the goal while retaining the stability features of the set up goal. The hinged connections of the member portions permits the goal to be folded into a small package for easy transport and storage.

As mentioned above, the stability features of the set up goal are achieved because the crossbar members are supported in the nature of a beam. As used herein, an overhanging beam is a beam which projects beyond one of its supports, a cantilever beam is a beam having one end fixed and one end free, and a fixed beam is rigidly fixed at both ends. Each beam has its advantages and drawbacks. For example, a fixed beam is extremely stable in supporting a load, but requires two supports; whereas, a cantilever beam only requires one support, but is not as stable in loading as a fixed beam. An overhanging beam, while requiring two supports, does not need both supports to be on the ends of the beam.

The present invention employs the concept of a beam to support the crossbar of the soccer goal in a stable manner. As stated above, the soccer goal of the present invention has a crossbar formed of two crossbar members. Each member is hinged between its ends and is attached at one end to an upright member. However, one of the two crossbar members is supported for a significant portion of its length by a support bar that is hingeably attached to an upright member. As mentioned above, each crossbar member and each upright member is formed of two portions. The height and width requirements placed on a soccer goal makes one-half the overall height dimension a significant portion of one-half of the width dimension. Therefore, if a support bar is stored in one of the upright member portions, that member will still have a length that is a significant portion of the length of a crossbar member portion.

Therefore, if one of the crossbar members is supported by the support bar, that crossbar member will be supported from one end thereof for a significant portion of its length. Therefore, the crossbar member will be supported in a manner of a modified overhanging beam. As used herein, a modified overhanging beam is a beam that extends beyond the support, but which is supported for a significant portion of its length, and, in fact, is supported for at least nearly one-half of its overall length. Thus, such a beam will have attributes of an overhanging beam because it will have one end extending beyond its support, but will also have attributes of a cantilever beam because it will require only one support. Still further, since the beam is supported for so much of its overall length, it also has some attributes of a fixed beam. When the goal is set up, the crossbar members are connected together, and thus will have the attributes of a fixed beam, but with one of the supports extending for nearly one-half the length of the beam. Thus, the modified beam of the soccer goal of the present invention has the advantages of the strength of either or both an overhanging beam and/or a fixed beam, yet also has the advantages of a cantilever beam's single support. The one-half dimension unit is chosen so the goal can be easily stored when it is disassembled, yet will still have the attributes of a modified overhanging beam as discussed above.

BRIEF DESCRIPTION OF THE DRAWING FIGURES

DETAILED DESCRIPTION OF THE PREFERRED EMBODIMENT OF THE INVENTION

Figure 1:
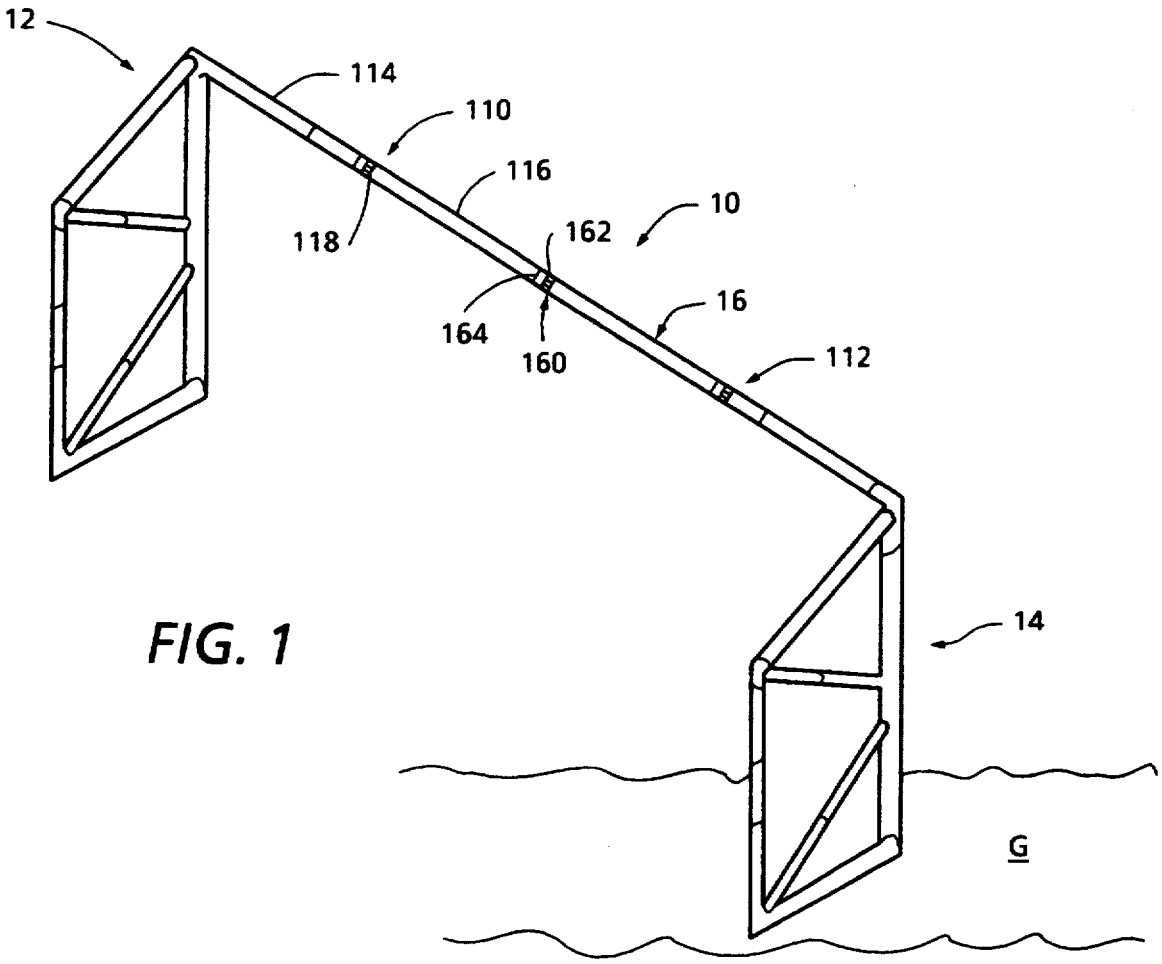
FIG. 1 is a top perspective view of the soccer goal embodying the present invention in the set up condition.

Shown in FIG. 1 is a soccer goal 10 embodying the present invention. Goal 10 includes two upright members 12 and 14 extending upward from the ground G and supporting a crossbar member 16 thereon. In the set up condition, goal 10 can be sized to meet NCAA and professional standards. Goal 10 is collapsible, yet is stable in the set up condition shown in FIG. 1. While a net is not shown, it will be supported on the upright members and on the crossbar and can any form of net commonly used for soccer.

Figure 2:
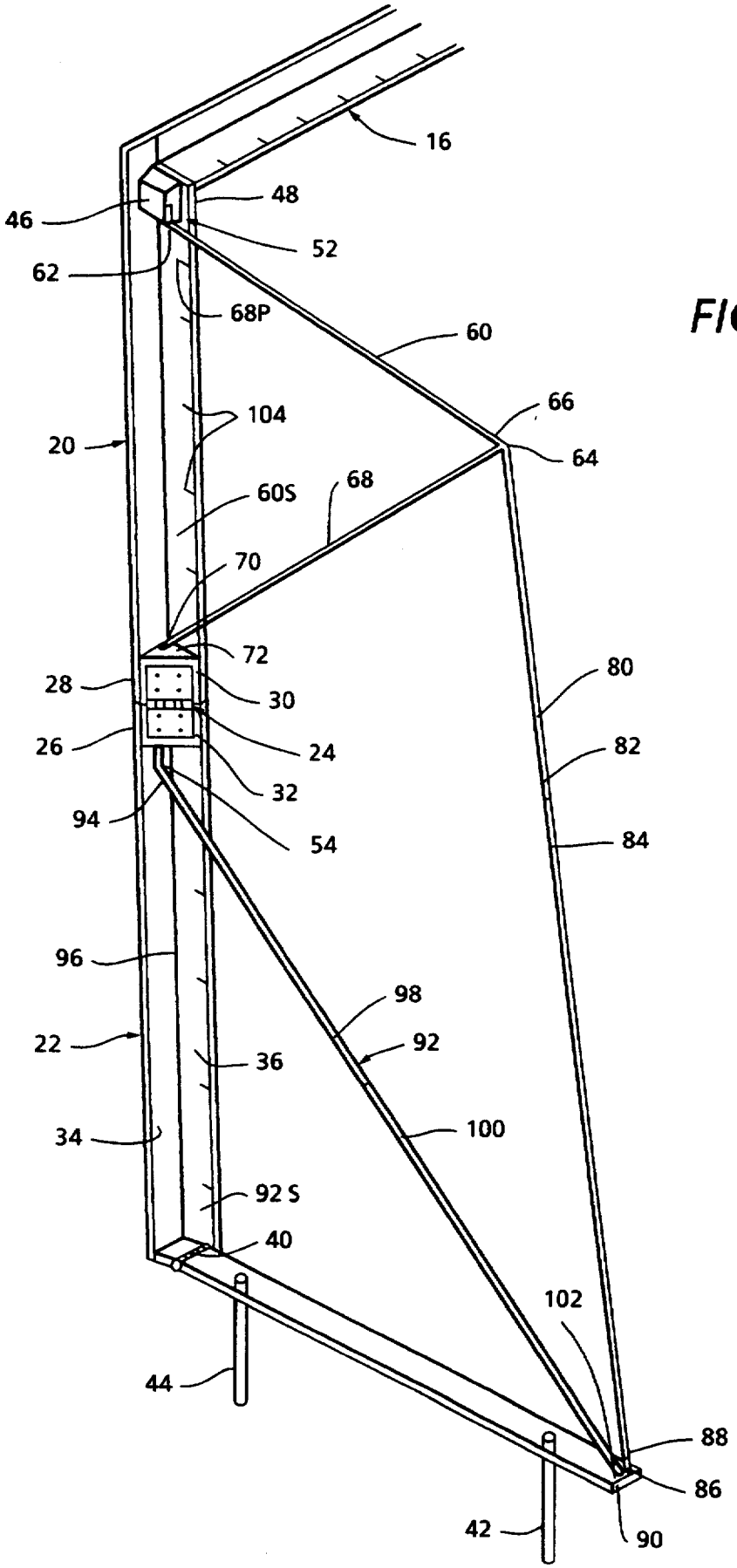
FIG. 2 is a side perspective view of the soccer goal with the crossbar partially cut away for the sake of ease of illustration.
Figure 3:
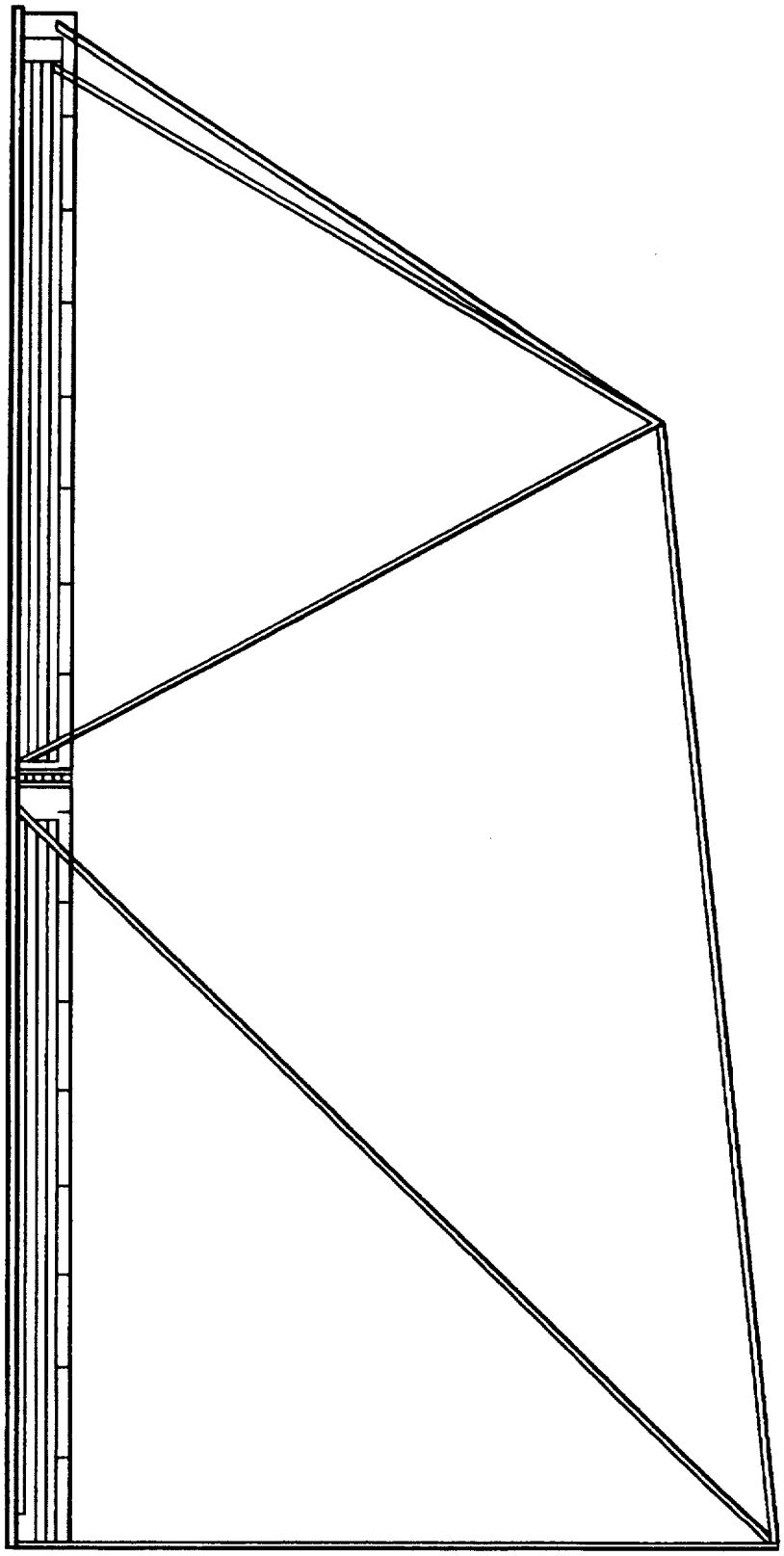
FIG. 3 is a side elevational view of the soccer goal showing the net supporting arms in the set up condition.
Figure 4:
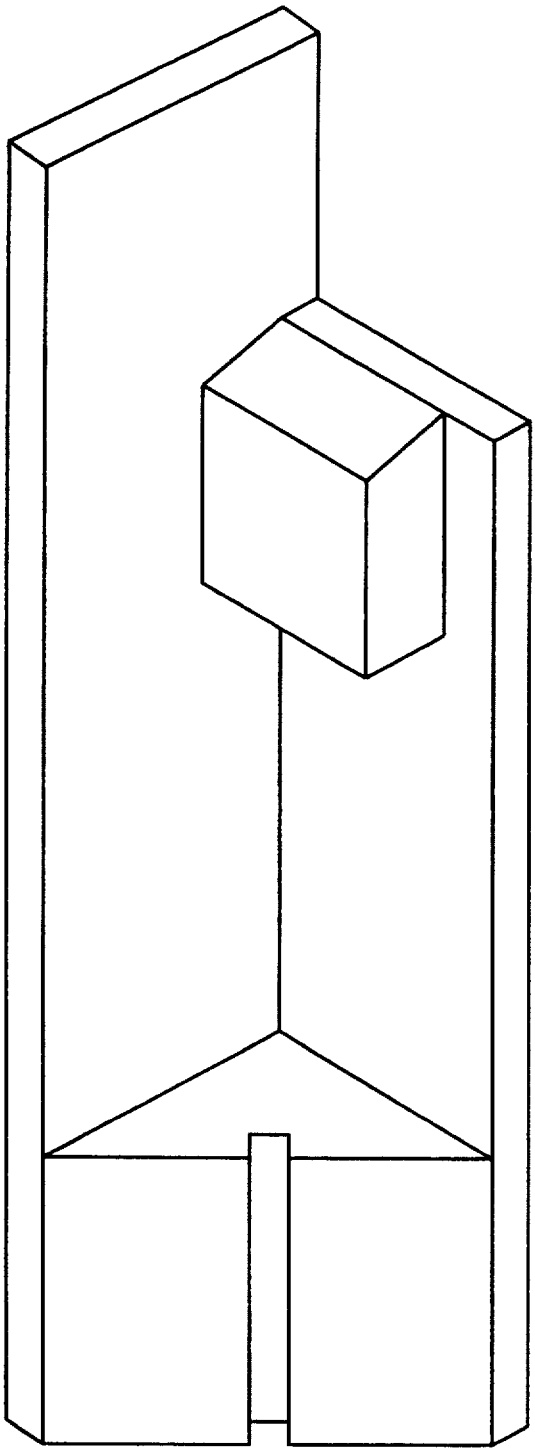
FIG. 4 is a perspective view of a top portion of an upright member.
Figure 5:
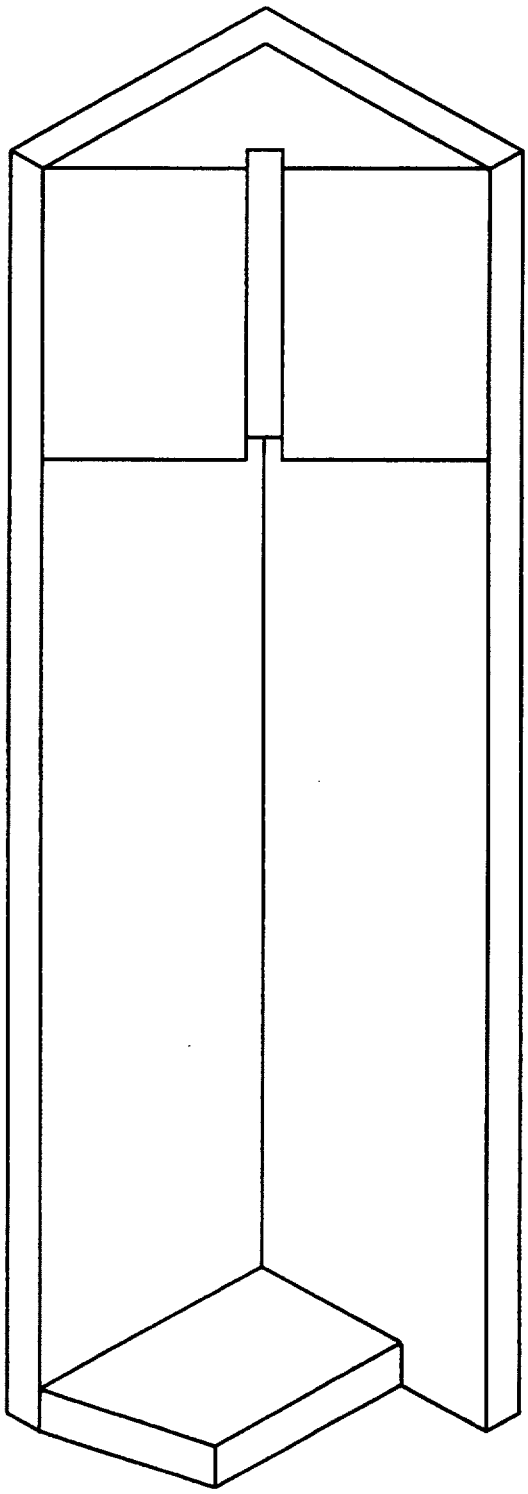
FIG. 5 is a perspective view of a bottom portion of an upright member.
Figure 6:
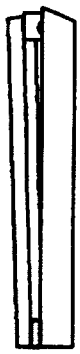
FIGS. 6–10 show the deployment from a stored condition to a set up condition of an upright member.
Figure 7:
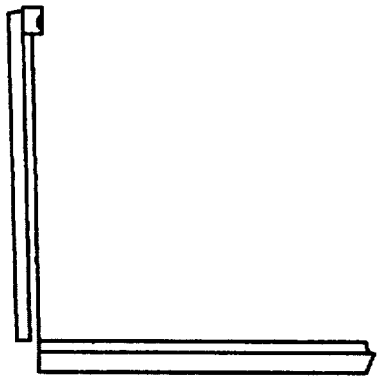
Figure 8:
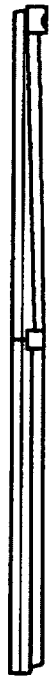
Figure 9:
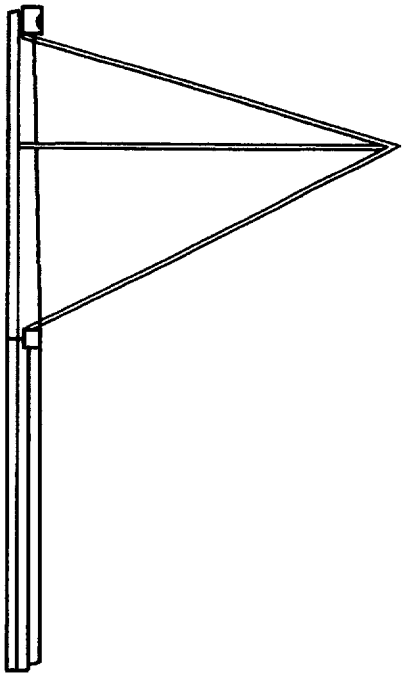

Specifically referring to FIGS. 2–5, each upright member includes a top portion 20 and a bottom portion 22 with a hinge 24 connecting a top end 26 of portion 22 to a bottom end 28 of top portion 20. Hinge 24 is a 180° hinge that permits top portion 20 and bottom portion 20 to lie next to each other in the collapsed condition as shown in FIG. 6. Hinge 24 is attached to hinge mounts 30 and 32 on portions 20 and 22 respectively. The preferred form each of the portions includes an L-shaped frame having a first face 34 and a second face 36, with first and second faces being coplanar at the bottom end of bottom portion 22 and having face 34 extend beyond the end of face 36 at the top end of top portion 20. The preferred form of the upright members has the hinges in the middle of the upright members, with the hinge being a locking hinge that locks in the deployed condition as shown in FIG. 2.

A 180° hinge 40 connects a base 42 to bottom portion 22. Base 42 includes two spiral anchors 44 and 46 that anchor the base to the ground. These anchors can be threadably attached to the base. As can be seen, base 42 extends rearwardly of the crossbar 16 for supporting the goal.

A hinge mount 46 is located on top end 48 of top portion 20. A 270° hinge 50 (see FIG. 11) is attached to mount 46 as is a 90° hinge 52. A 90° hinge 54 is attached to bottom portion 22 on mount 26. The hinges will not be fully discussed as one skilled in the art will be able to select a suitable hinge based on the teaching of the present disclosure.

As shown in FIG. 2, a first net-supporting arm 60 is supported at a proximal end 62 thereof on hinge 52 to move between a stored position 60S adjacent to face 34 of top portion 20 and the deployed condition 90° from the stored position and shown in FIG. 2. A hinge 64 is located on distal end 66 of arm 60, and a net-supporting arm 68 is attached at one end thereof to arm 60 by hinge 64. Arm 68 moves between a deployed condition shown in FIG. 2 and a stored condition next to arm 60, with end 70 of arm 68 moving between a supporting position on top surface 72 of mount 30 as shown in FIG. 2 and a stored position 68P closely adjacent to proximal end 62 of arm 60 when the goal is in the knocked-down condition. A third net-supporting arm 80 is connected at one end thereof to hinge 64 to move between the deployed condition shown in FIG. 2 and a stored condition adjacent to arm 68. Arm 80 is extendable so it extends from a length essentially equal to the length of arm 68 to the length shown in FIG. 2. Therefore, arm 80 includes a plurality of telescopingly connected sections, such as sections 82 and 84 indicated in FIG. 2. Arm 80 has a distal end 86 that is received in an anchor 88 on distal end 90 of base 42.

Another net-supporting arm 92 is connected at a proximal end 94 thereof to hinge 54 to move between a deployed condition shown in FIG. 2 and a stored condition 92S adjacent to corner 96 formed by the intersection of faces 34 and 36 of bottom portion 22. Arm 92 is extendable, and includes at least two telescopingly connected sections 98 and 100, and includes a distal end 102 abutting anchor 88 in the set up condition.

Figure 10:
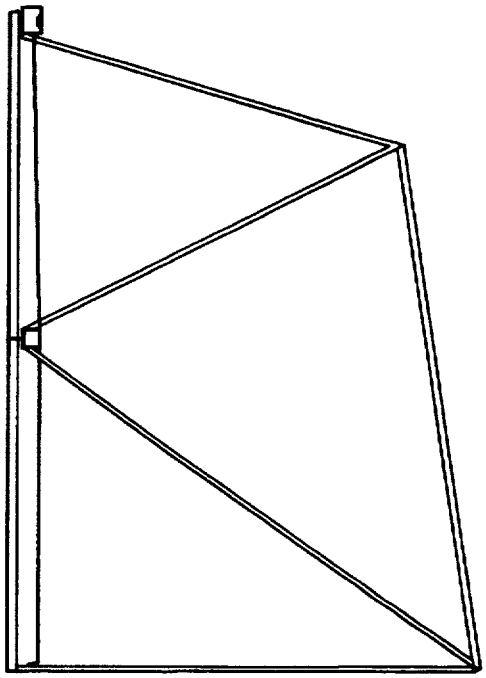

As mentioned above, both upright members 12 and 14 are identical; therefore, only one upright member will be described. In the set up condition, the upright members will support the goal and the net, with the net being connected to the upright members by net hooks, such as hooks 104. The primary purpose of the net supporting arms is to support a net and to suport the upright members in order that the goal will have stability if struck by a ball during play, therefore, these arms need be strong enough only to achieve this purpose. The upright members are deployed from a stored condition shown in FIG. 6 to a set up condition shown in FIGS. 2 and 10 as indicated in those figures.

Figure 11:
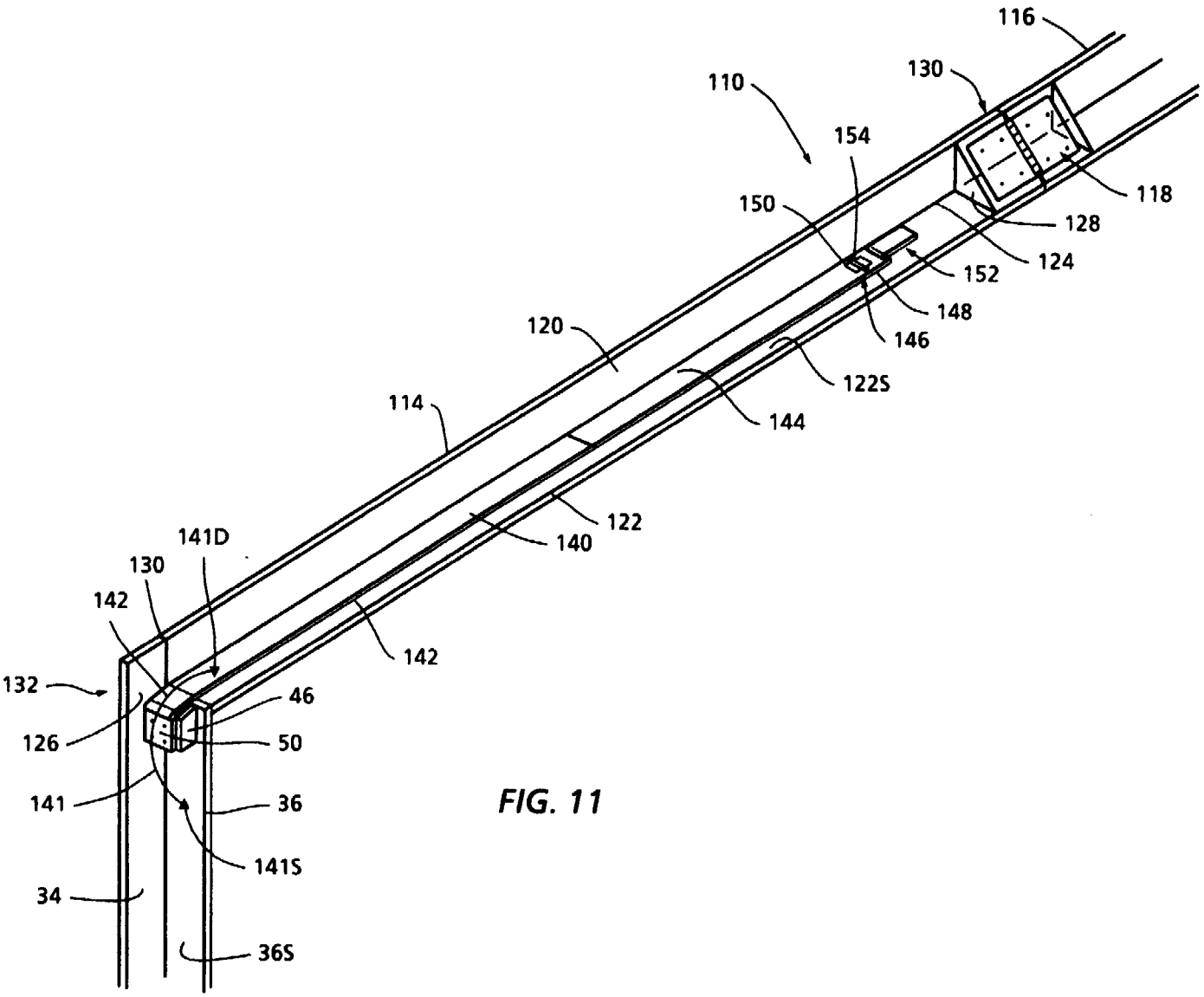
FIG. 11 is a perspective view of one of the two support elements forming one of the two crossbar members, with the support element being supported in the manner of a modified overhanging beam, with the other crossbar support element being only partially shown for the sake of ease of illustration.

As shown in FIGS. 1, 2 and 11, crossbar 16 includes two support elements 110 and 112, each of which includes two portions 114 and 116, connected together by a 1800 hinge, such as hinge 118 to fold onto each other in a collapsed condition. Hinge 118 is similar to hinges 24 and can lock in the open condition shown in FIG. 11. Portions 114 of the elements are identical to each other and portions 116 of the elements are identical. Therefore, only element 110 will be described.

As best shown in FIG. 11, element 110 includes a face 120 and a face 122 which intersect to form a corner 124. Face 122 is sized to correspond in width to face 36 and face 120 is sized to correspond in width to the overhang 126 of face 34 of top portion 20. A hinge mount 128 is located on a distal end 130 of member 114, with proximal end 130 of member 114 abutting top end 132 of portion 20 when the crossbar is in the set up condition as shown in FIG. 11.

As discussed above, crossbar members 110 and 112 are supported in a manner that makes them modified overhanging beams whereby the advantages of an overhanging beam can be combined with the advantages of a fixed beam as well as the advantages of a cantilever beam but the disadvantages of each such beams are minimized if not totally avoided.

A crossbar support bar 140 is attached at a proximal end 142 thereof to hinge 50 to move between a stored condition adjacent to face 36 of portion 20 and a deployed condition 270° therefrom as shown in FIG. 11. Movement of bar 140 is indicated in FIG. 11 by double-headed arrow 141, with the stored condition being indicated by head 141S, and the deployed condition being indicated by head 141D. Bar 140 includes two telescopingly connected sections 142 and 144, and has an attaching lock 146 on the distal end 148 thereof. Lock 146 includes a cutout section 150 in bar 140 and a cover 152 attached to the bar. A lock element 154 is rotatably mounted on bar 140 and extends through the section 150 when the element is oriented parallel to the length dimension of bar 140 and will engage bar 140 adjacent to cutout 150 when the element is oriented perpendicular to the length dimension of the bar 140 as shown in FIG. 11. In the FIG. 11 orientation, element 154 locks distal end 148 of bar 140 to member 114 thereby locking bar 140 to that member at both the distal and proximal ends of that bar. Bar 140 extends for nearly the entire length of member 114, and thus extends for nearly one-half the overall length dimension of crossbar element 110. Thus, the crossbar element 110 is supported for a significant portion of its overall length. The telescoping nature of bar 140 permits this bar to fit in top portion 20 in the stored configuration, yet to reach far enough on bar 114 to support that element for a significant portion of its overall length. Cover 152 can be used to ensure that, once locked, the bar 140 is not likely to free itself from the element 114.

As also mentioned above, when element 116 is connected to its corresponding element 116 in member 112, the overall crossbar 16 will be supported at both ends in the manner of a fixed beam, but the supports will extend for a significant portion of the overall length of the crossbar whereby the crossbar is extremely secure and stable. However, the crossbar can be easily disassembled and placed in a stored configuration. Still further, the support bar 140 is attached to a top surface 122S of the crossbar and to suface 36S of the corresponding upright member. Thus, forces required to stably support the crossbar are transferred in an efficient manner among the support bar 140 and the upright member.

The crossbar portions 110 and 112 are connected together by a lock 160 similar to lock 150 with a latch 162 on one portion having a pin-receiving hole defined therein and a pin 164 rotatably mounted on the other portion and being received through the hole when the pin is in one orientation relative to the latch and abutting the latch when the pin is in a second position to lock the two portions together and form a single crossbar 16 as shown in FIG. 1.

It is understood that while certain forms of the present invention have been illustrated and described herein, it is not to be limited to the specific forms or arrangements of parts described and shown.

I claim:

1. A collapsible soccer goal comprising:

A) two upright members, each including (1) a top portion having a top end and a bottom end, a 270° hinge connected to said top end, a first 180° hinge connected to said bottom end, a first net-securing arm hingeably connected at a proximal end thereof to said top portion adjacent to said top end, a second net-supporting arm hingeably connected to a distal end of said first net-supporting arm and having a proximal end, a third net-supporting arm hingeably connected to the distal end of said first net-supporting arm, said third net-supporting arm being expandable, (2) a bottom portion having a top and a bottom, a second 180° hinge connected to said bottom, said top being connected to said first 180° hinge, and expandable net-supporting arm hingeably connected at a proximal end thereof to said bottom portion adjacent to said top, (3) a base connected at one end thereof to said second 180° flange, means on a distal end of said base for connecting said base to said third net-supporting arm and to said expandable net-supporting arm, and (4) an anchor element on said base for anchoring said base to the ground; and B) a crossbar which includes (1) two crossbar portions, each extending from an upright member in the manner of a beam, (2) each crossbar portion including two sections, (3) a third 180° hinge connecting the two sections of each crossbar portion together, (4) a crossbar support bar connected at a proximal end thereof to a 270° hinge and extending from that hinge and having a length that is over one-half the length of a crossbar section, (5) locking means for locking said crossbar support bar to one of said two sections at a location spaced from the proximal end of the section whereby said section is supported by said support bar for over one-half the length of said section.

2. The collapsible soccer goal defined in claim 1 wherein said two crossbar portions extend from said upright portions in the manner of an overhanging beam.

3. The collapsible soccer goal defined in claim 1 wherein said two crossbar portions extend from said upright portions in the manner of a cantilever beam.

4. The collapsible soccer goal defined in claim 1 further including a plurality of net hooks on said upright members.

5. The collapsible soccer goal defined in claim 4 further including a hinge mount for each of said 270° hinges.

6. The collapsible soccer goal defined in claim 1 wherein said crossbar support bar is extendable.

7. The collapsible soccer goal defined in claim 1 wherein the sections of each crossbar portion are essentially equal in length to each other.

8. The collapsible soccer goal defined in claim 1 wherein said crossbar support bars are attached to a top surface of said crossbar.

* * * * *